US005429194A

United States Patent [19]

Nice

[11] Patent Number: 5,429,194

[45] Date of Patent: Jul. 4, 1995

[54] METHOD FOR INSERTING A WIRELINE INSIDE COILED TUBING

[75] Inventor: Sidney B. Nice, Humble, Tex.

[73] Assignee: Western Atlas International, Inc., Houston, Tex.

[21] Appl. No.: 235,547

[22] Filed: Apr. 29, 1994

[51] Int. Cl.[6] ..... E21B 23/08

[52] U.S. Cl. ..... 166/383; 166/385; 166/77

[58] Field of Search ..... 166/383, 384, 385, 70, 166/77

[56] References Cited

U.S. PATENT DOCUMENTS

| | | | |
|---|---|---|---|
| 3,116,793 | 3/1961 | McStravick . | |
| 3,285,629 | 12/1963 | Cullen et al. . | |
| 3,312,282 | 4/1967 | Yerman | 166/383 |
| 3,346,045 | 10/1967 | Knapp et al. | 166/383 X |
| 3,394,760 | 7/1968 | Childers et al. | 166/383 |
| 3,401,749 | 9/1968 | Daniel | 166/77 X |
| 3,496,998 | 2/1970 | Weaver | 166/383 X |
| 3,525,401 | 8/1970 | Hanson et al. | 166/153 X |
| 4,850,440 | 7/1989 | Smet . | |
| 5,180,009 | 1/1993 | Sneed | 166/383 X |

OTHER PUBLICATIONS

Coiled Tubing Handbook, Edited by Mark E. Teel; Reprinted from World Oil, Gulf Publishing Company, 1993.

Atlas Wireline Services Brochure, "Extended-Reach and Horizontal Well Services", 1990.

*Primary Examiner*—Hoang C. Dang

*Attorney, Agent, or Firm*—Richard A. Fagin

[57] ABSTRACT

The invention is a method for installing a wireline inside a coiled tubing. A first piston is attached to one end of the wireline. A pump-through head with a removable packing and a fluid inlet is attached to one end of the coiled tubing. The wireline and first piston are inserted through the pump-through head. The removable packing is reinstalled. Fluid pressure is applied by a pump to the fluid inlet. A section of wireline has been pumped into the coiled tubing. The pump is stopped. The packing is removed. A second piston for suspending the wireline from contact with the tubing is installed on the wireline. The steps are repeated at spaced apart intervals along the wireline until the wireline is inserted in the coiled tubing.

10 Claims, 6 Drawing Sheets

METHOD FOR INSERTING A WIRELINE INSIDE COILED TUBING

BACKGROUND OF THE INVENTION

1. Field of the Invention

The present invention is related to the field of electric wireline oil well servicing tools. More particularly, the present invention is related to the use of electric wireline tools which are lowered into a wellbore by means of coiled tubing. Coiled tubing is typically used to transport well servicing tools, including electric wireline tools, to the bottom of a wellbore which has been drilled nearly horizontally. In these cases, gravity cannot transport the tools to the bottom of the wellbore, so conveyances such as coiled tubing are necessary.

2. Discussion of the Related Art

Conveyance of well servicing tools to the bottom of highly deviated wellbores with drillpipe or workover rig tubing is known in the art. For example, "Extended Reach and Horizontal Well Services", Western Atlas International Houston, Tex. 1990, describes some of these methods. Drillpipe or workover tubing is formed from thirty foot long sections with threaded connections at each end. The threaded connections join the ends of each section to form a continuous length of pipe. The time consumed in threading these connections together is considerable.

Use of coiled tubing in drilling and workover operations, for replacing the step of assembling the sections of drillpipe or tubing, is also known in the art. U.S. Pat. No. 3,116,793 teaches a method of using coiled tubing to pump completion and workover fluids to a desired depth in a wellbore. U.S. Pat. No. 4,850,440 teaches a method of creating a wellbore with a coiled tubing conveyed drilling apparatus. U.S. Pat. No. 3,285,629 teaches a method of conveyance of electrically powered tools, which could include electric wireline tools, by a continuous hose having a nested electrical cable. The invention disclosed in U.S. Pat. No. 3,285,629 is a drilling tool which is conveyed to the desired depth by gravity. The weight of the drilling tool itself provides the conveyance force required. Consequently, conveyance of tools using the hose disclosed in U.S. Pat. No. 3,285,629, to the bottom of a highly deviated or horizontal wellbore would be difficult since the force of gravity would be largely dissipated by friction with the bottom wall of the wellbore. Additionally, the electrical cable described in this patent is assembled into a continuous length from discrete sections joined by connectors. The use of these connectors would add significantly to the cost of the electric wireline.

The use of electric wireline tools conveyed by coiled tubing into deviated wells is also known in the art. "World Oil's Coiled Tubing Handbook", Gulf Publishing Co., Houston, Tex. 1993, describes such operations in detail. The use of coiled tubing to convey electric wireline tools requires that the electric wireline be inserted coaxially through the entire length of coiled tubing. "World Oil's Coiled Tubing Handbook", referenced above, discloses a method for installing electric wireline inside coiled tubing. The coiled tubing is unspooled into a generally straight shape and the electric wireline is then pumped through the unspooled tubing. This operation requires either the use of a wellbore deep enough to accommodate the unspooled length of tubing, or unspooling the tubing along the ground. Obtaining the use of a wellbore with sufficient depth is difficult and expensive. Unspooling the tubing along the ground in a roughly straight line is difficult since the length of the tubing often exceeds three miles. In either of these methods, the tubing must undergo an additional unspooling to install the wireline. Additional unspooling of the tubing shortens its useful working lifespan because of the bending stress applied to the tubing as a result of the spooling process.

Insertion of the electric wireline inside the coiled tubing while the tubing is still spooled is difficult because of the frictional forces developed between the interior wall of the tubing and the wireline as the wireline insertion progresses. The wireline tends to rest upon the inside radius of the wall of the coiled tubing. As insertion of the wireline proceeds, the total contact area between the wireline and the tubing increases. The contact area between wireline and coiled tubing would be the same as in the case of unspooled tubing, but the tubing is wound in a roughly circular pattern so a partial component of the tension applied to the cable during insertion acts in a direction normal to the axis of the wireline. This normal force is similar in effect to the application of weight upon wireline travelling through unspooled tubing. The friction between cable and tubing is proportionately increased with each succeeding wrap around the spool by the wireline. The result is that substantially before the wireline reaches the end of the coiled tubing, the frictional forces developed would exceed the safe tension loading of the wireline and the installation would fail.

SUMMARY OF THE INVENTION

The present invention is a method for inserting a wireline inside a coiled tubing. A pressure-sealing, pump-through head, with a fluid inlet fitting and removable packing seal, is attached to the free end of the coiled tubing. A fluid pump discharge is connected to the fluid inlet fitting of the pump-through head. A piston is attached to the end of the wireline to be inserted in the reel. The piston is inserted into the pump-through head and the pump-through head is resealed. Fluid pressure from the pump pushes the piston into the coiled tubing. The wireline travels with the piston, to which the wireline is attached.

In one embodiment of the invention, a plurality of suspension blocks, holding the wireline out of wall contact with the coiled tubing, are mounted at spaced apart locations along the wireline. Periodically the pump is stopped, the packing is removed from the pump-through head, and a suspension block is installed. The suspension block installation is repeated periodically until the wireline is completely inserted through the tubing.

In an alternative embodiment of the invention, the pump-through head and fluid pump used in the first embodiment are also used. A plurality of pistons, each having pressure rupture disks, are mounted at spaced apart locations along the wireline. The pistons transport the wireline by the hydraulic force generated by the pump. The pressure rupture disks enable reestablishment of hydraulic circulation capability through the coiled tubing by application of sufficient pressure to the coiled tubing while restraining the wireline from movement.

Another alternative embodiment of the invention also uses second pistons attached to the cable at spaced apart locations. The second pistons of this embodiment function in substantially the same way as the second pistons of the second embodiment. The second piston of the present embodiment comprises a small-diameter housing which clamps onto the cable, and a body molded to the housing, the body having an outside diameter substantially the same as the inside diameter of the coiled tubing. The body of the second piston is comprised of material which can be dissolved in a chemical solvent pumped into the tubing. Fluid flow can thus be enabled through the pistons.

Another embodiment of the present invention has second pistons attached to the cable at spaced apart locations. The second piston of the present embodiment can be formed from a material substantially the same as the second piston of the third embodiment in that introduction of a selected solvent into the coiled tubing will dissolve the second pistons. The second piston of the present embodiment is molded directly on to the cable.

DESCRIPTION OF THE PREFERRED EMBODIMENT

Figure 1:
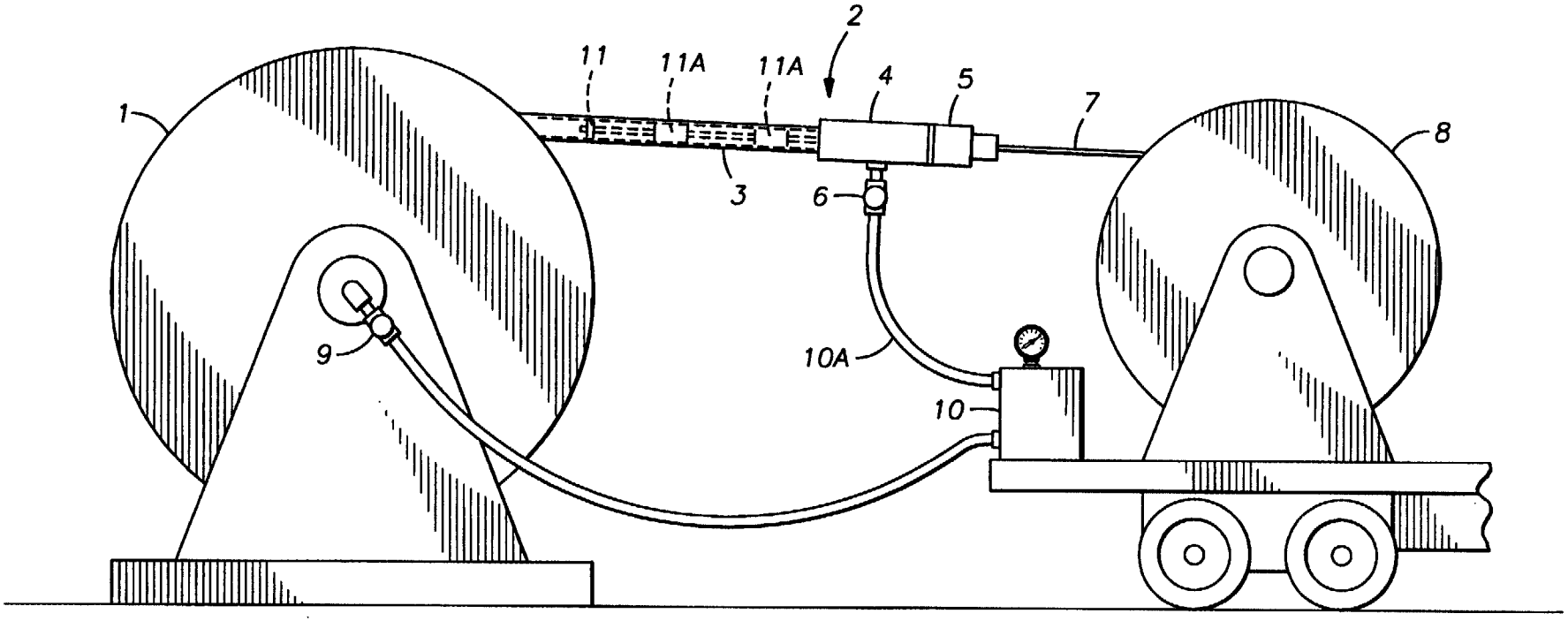
FIG. 1 shows the invention as typically used.

FIG. 1 depicts the invention in typical use. Coiled tubing 3 into which a wireline or cable 7 is to be installed, is wound on a transport reel 1. The cable 7 is spooled on a drum 8 of the type normally used for the purpose of spooling wireline or cable. The coiled tubing has a free end 2, which is the last section of the tubing 3 taken up by the reel 1 during respooling the tubing 3. A pump-through pressure sealing head 4 is attached to the free end 2 of the tubing 3. This pump-through head 4 is of a type widely used in wellhead pressure control for wireline operations. The pump-through head 4 includes a removable packing 5, which creates a pressure seal over the cable 7 when the packing 5 is installed, and when the packing 5 is removed, enables devices mounted on the cable 7 which exceed the external diameter of the cable 7 to pass through the pump-through head 4 and into the tubing 3. The pump-through head 4 also has a fluid inlet 6 to permit injection of fluid. A pump 10 provides operating pressure to move the cable 7 through the tubing 3. The pump 10 discharge is connected by a hose or line **10*a* to the fluid inlet 6. A pressure sealing piston 11 is affixed to the end of the cable 7 to be inserted into the tubing 3. The piston 11 clamps on to the cable 7. The piston 11 external diameter is substantially the same as the internal diameter of the tubing 3 and creates a pressure seal in the annular space between the tubing 3 and cable 7. The piston 11 is inserted through the pump-through head 4, and the removable packing is installed. The pump 10 is activated and the fluid pressure generated by the pump 10 acts on the piston 11, forcing it into the tubing 3. The pump 10 is stopped after about 10 to 15 feet of the cable 7 have been pumped into the tubing 3. The accumulated fluid pressure is allowed to discharge, and the packing 5 is removed to allow installation of a suspension block 11*a*. The suspension block 11*a* holds the cable 7 off the interior wall of the tubing 3. This reduces the frictional forces which would otherwise compound if the cable 7 and tubing 3 came into unrestricted contact. After the suspension block 11a is installed, the packing 5 is replaced, and the pump 10 is restarted. The cable 7 is pumped into the tubing 3 until the location for an additional suspension block 11*a* is reached, and the process of installing the suspension block 11*a* is repeated until the entire cable 7 is pumped into the tubing 3. The distance between successive installations of suspension blocks 11*a* can be approximately the length of cable 7 which traverses one-quarter to one-eighth of the reel 1, which depends on the internal diameter of the tubing 3. Typically the distance between suspension blocks 11*a* is 10 to 15 feet, but larger diameter tubing 3 will have a larger radius of curvature, which will increase the effective distance between suspension blocks 11*a***.

Figure 2:
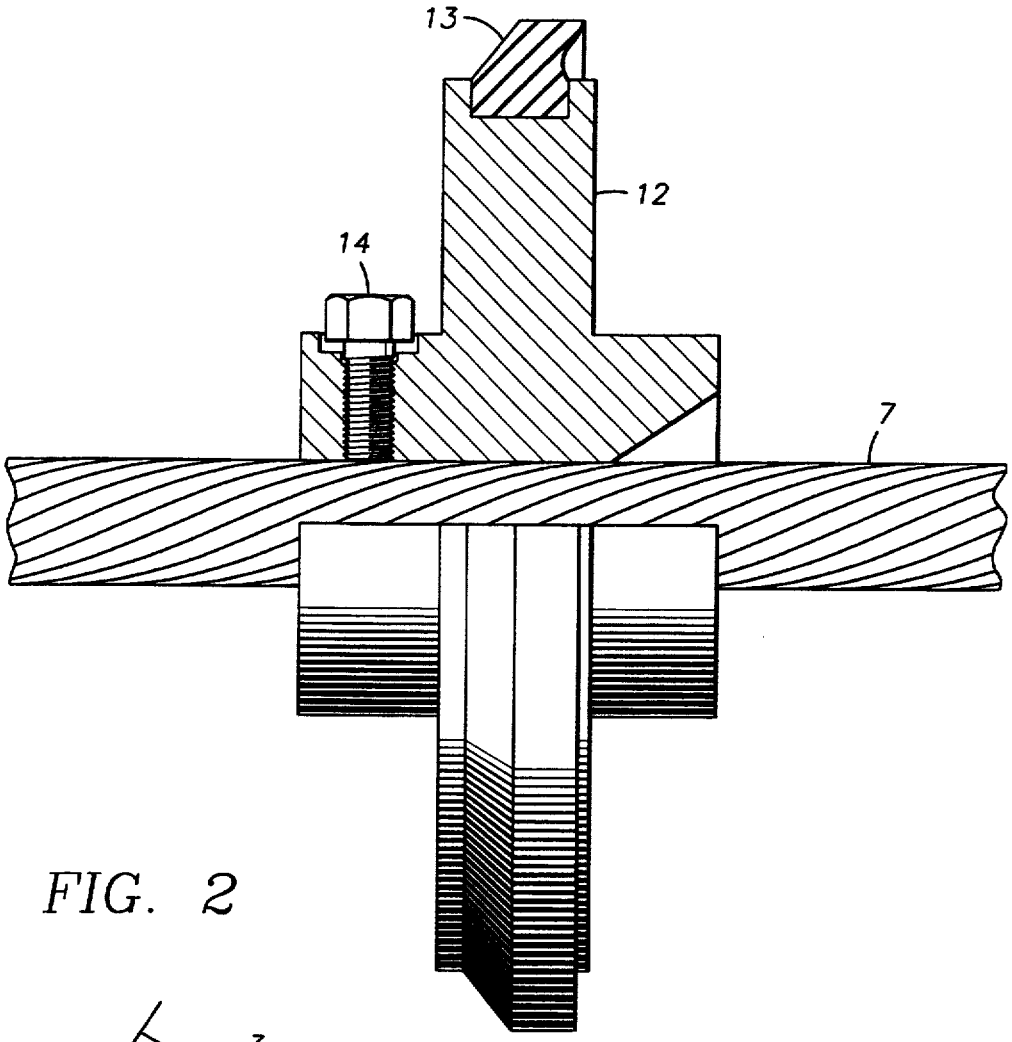
FIG. 2 shows a detail of the piston attached to the installed end of the wireline.

FIG. 2 shows the piston 11 in detail. The center of the body of the piston 11 is bored to a diameter matching the external diameter of the cable 7. A locking bolt 14 provides clamping force to hold the piston 11 in place on the cable 7. The piston 11 has a groove **11*b* machined in the outside diameter to accommodate a seal cup 13. The cup 13 can be similar in construction to swabbing cups commonly used to lift fluids out of oil and gas well production tubing. Fluid pressure from the pump 10 will cause the piston 11 to move in the direction of fluid flow, pulling the cable 7** with it.

Figure 3:
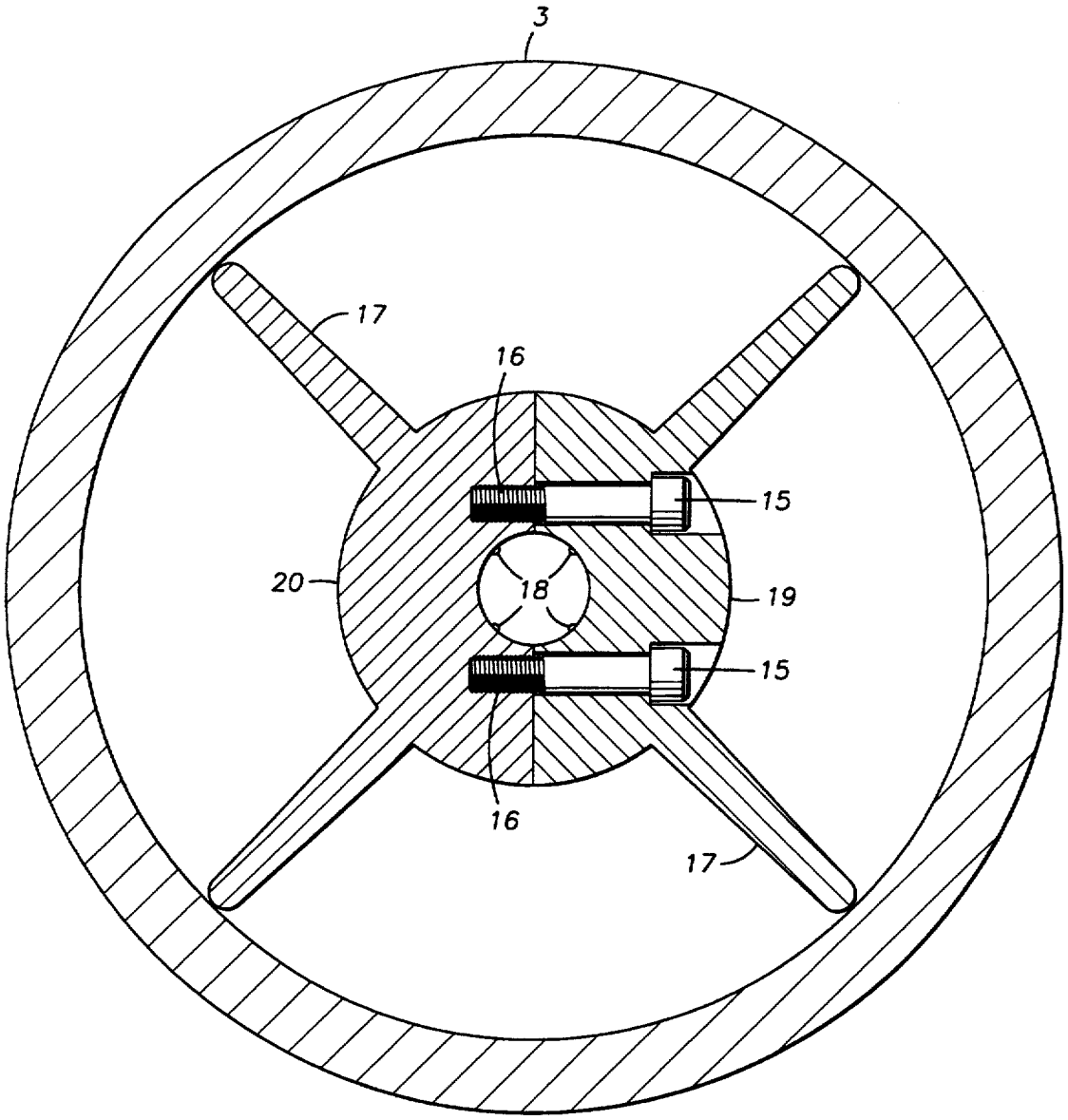
FIG. 3 shows an end view of the wireline suspension block of the preferred embodiment of the invention.

FIG. 3 shows an end view of a suspension block **11*a* used in the first embodiment. An upper half 20, and a lower half 19 are screwed together with capscrews 15 in threaded holes 16 drilled through both the upper half 20 and the lower half 19. The center bore of the suspension block 11*a*, is drilled to the same diameter as the external diameter of the cable 7 and has ribs 18 to increase friction with the cable 7. The additional friction reduces the possibility of movement of the suspension blocks 11*a* along the cable 7 during operation. Projections 17 formed into the body of the suspension block 11*a* subtend a diameter which is substantially the same as the internal diameter of the tubing 3. The projections 17 contact the inner wall of the tubing 3, holding the cable 7 away from the interior wall of the tubing 3. The body of the suspension block 11*a* is of a much smaller diameter than the inside diameter of the tubing 3 so as to create a flow passage 21 around each of the projections 17. The flow passage 21 is needed for proper operation of the tubing 3 in actual field use, because it is a functional requirement that fluid can be pumped through the tubing 3**.

Figure 4:
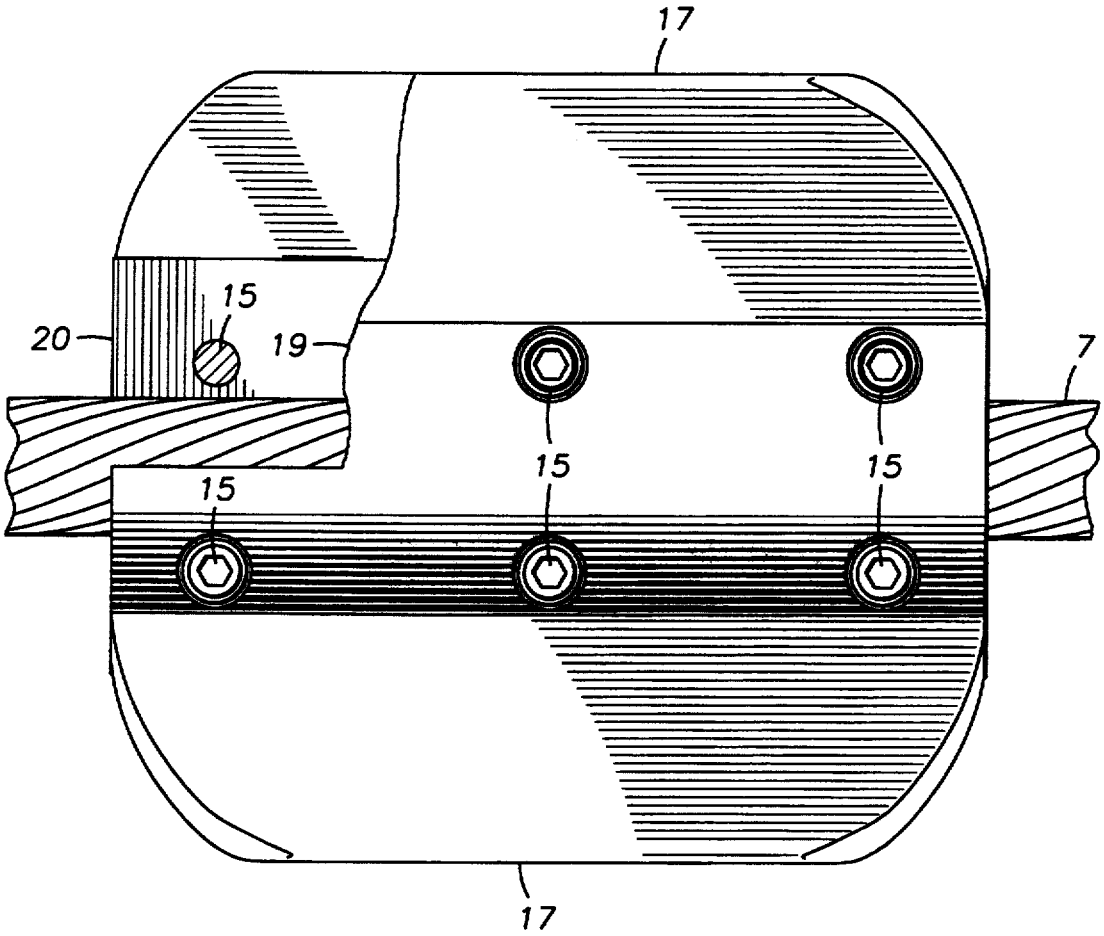
FIG. 4 shows the side view of the suspension block of FIG. 3.

A side view of the suspension block **11*a* is shown in FIG. 4. Capscrews 15 are located on the main body of the suspension block 11*a* at the base of the projections 17**.

DESCRIPTION OF ALTERNATIVE EMBODIMENTS

Figure 5:
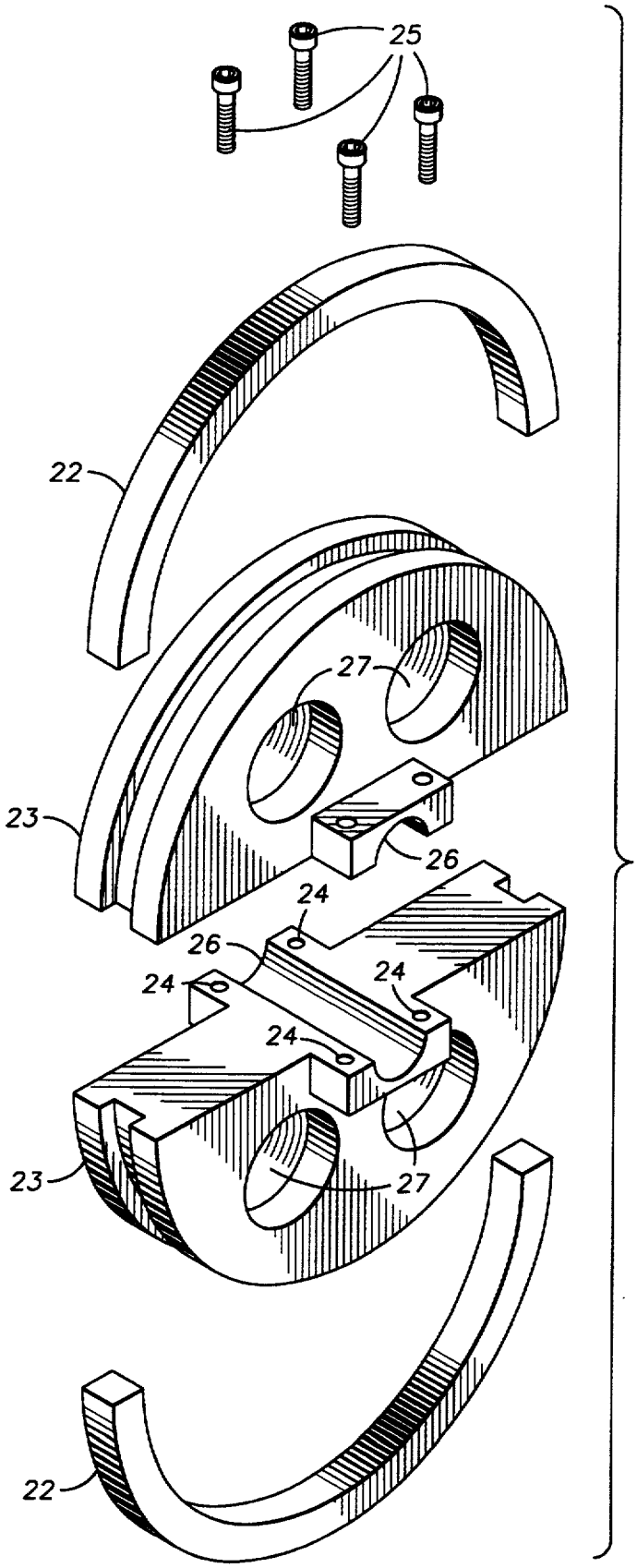
FIG. 5 shows a second piston with pressure rupture disks.

FIG. 5 shows a different type of suspension block, which is a second piston, shown in FIG. 1 as **11*a*, which can be mounted on the wireline. The second piston is composed of two half-sections 23 which clamp over the wireline through a center bore 26 formed by clamping the two half-sections together. Capscrews 25 join the half-sections 23 by threading through screw bosses 24 machined into the clamping area of the half-sections 23. The outside diameter of the assembled second piston 11***a* can be substantially the same as the inside diameter of the tubing 3. A pressure seal is effected by a split seal 22, which mounts on the outer rim of the second piston 11*a*. Referring back to FIG. 1, the assembled piston is inserted through the pump-through head 4 just as is the suspension block 11*a* described in the first embodiment. Fluid pressure from the pump 10 forces the piston (also depicted as 11*a* in FIG. 1) closest to the pump-through head 4 into the coiled tubing 3. The second piston 11*a* seals in both directions, so that fluid downstream from the second piston 11*a* is compressed between the second piston 11*a* closest to the pump 10 discharge, and the next second piston 11*a* downstream from it on the cable 7. This fluid compression moves the downstream second piston 11*a* in the same direction as the upstream second piston 11*a* acted upon directly by the pump 10 pressure. As the cable 7 travels an appropriate distance into the tubing 3, the pump 10 is stopped and the process of installing an additional piston 11*a* is repeated. All the pistons 11 and 11*a* are carried along with the fluid into the tubing 3, carrying the wireline 7 with them. At appropriate intervals, an additional second piston 11*a* is installed on the cable 7 successively until the cable 7 is completely inserted through the tubing 3.

Referring back to FIG. 5, rupture disks 27 are machined into the surface of the half-sections 23 of each second piston 11*a*. The rupture disks 27 can be designed to break open at a predetermined differential pressure across the disk 27. The purpose for the rupture disks 27 on the second pistons 11*a* is to enable hydraulic circulation capability through the coiled tubing 3 with the cable 7 installed. When the cable 7 is fully installed, the disks 27 are ruptured by restraining the drum 8 end of the cable 7 and applying fluid pressure from the pump 10 in excess of the rupture pressure of the disks 27. The rupture of the disks 27 can be confirmed by a distinct drop in the observed discharge pressure of the pump 10 compared to the pressure observed with the disks 27 still intact. The coiled tubing 3, with the cable 7 installed, is then capable of sustaining the fluid circulation required in normal use in a wellbore.

Figure 6:
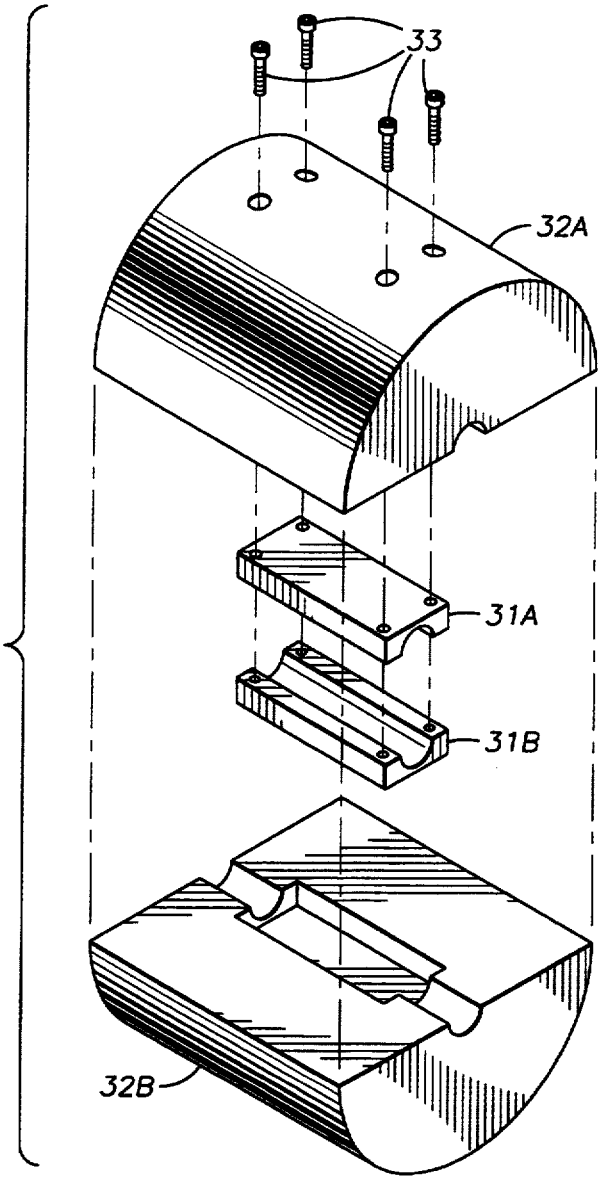
FIG. 6 shows a second piston with a body designed to be dissolved by caustic solution.

FIG. 6 shows another alternative embodiment, which is a second piston 30. A plurality of the second pistons 30 are mounted at spaced apart locations along the cable 7. The second piston 30 comprises a housing 31 which mounts to the cable 7 by clamping half sections 31A and 31B of the housing 31 together with capscrews 33, and a body 32 which is formed from half sections 32A, 32B which are individually molded to the housing half sections 31A, 31B. When assembled, the half sections 32A, 32B form a substantially cylindrically shaped body 32 which substantially seals fluid flow inside the coiled tubing 3. The body 32 subtends an external diameter substantially the same as the internal diameter of the coiled tubing 3, which is how the pressure seal is formed. The body 32 can be composed of a soft aluminum alloy which will dissolve when an appropriate solvent, such as a caustic solution comprised of calcium hydroxide in water, is pumped into the coiled tubing 3. The insertion and pumping of the second pistons 30 of this embodiment are substantially the same as the insertion and pumping of the second pistons of the second embodiment. Upon completing the insertion of the cable 7 in the tubing 3, the caustic solution is pumped into the tubing 3 through the pump 10. The soft aluminum alloy of the body 32 is dissolved by the caustic solution. Pumping of the caustic solution continues until all the bodies 32 are dissolved. Upon dissolution of all the bodies 32 of the second pistons 30 attached to the cable 7, fluid circulation capability through the coiled tubing 3 is established, and the coiled tubing 3 is ready for use.

Figure 8:
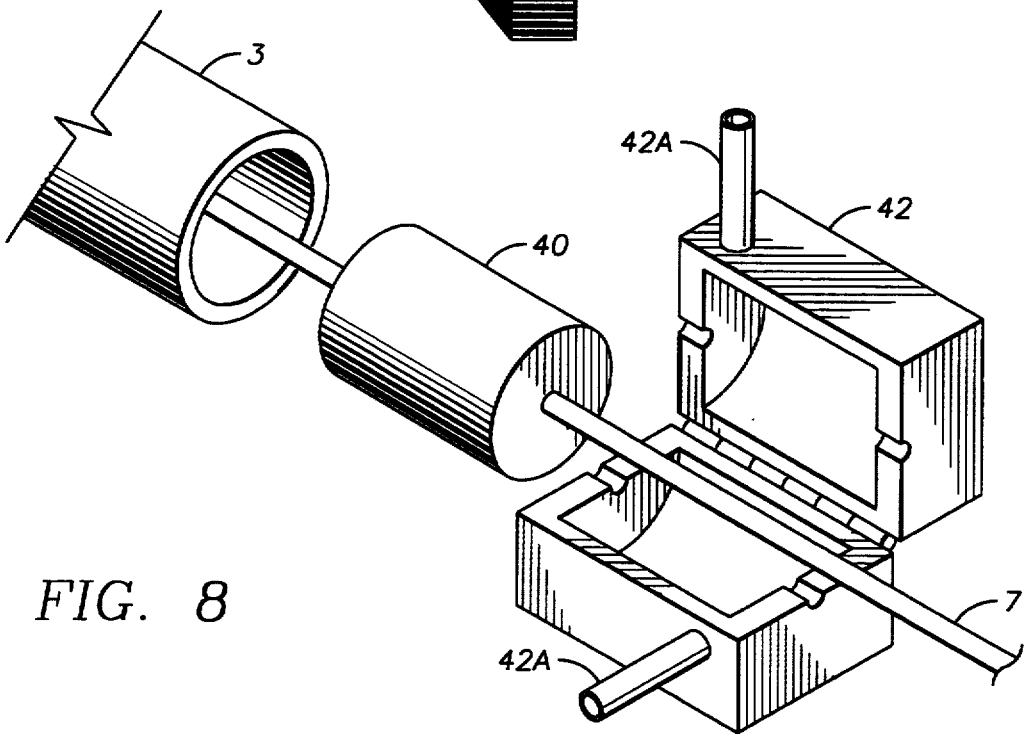
FIG. 8 shows a mold form for directly molding pistons on to the wireline.
Figure 7:
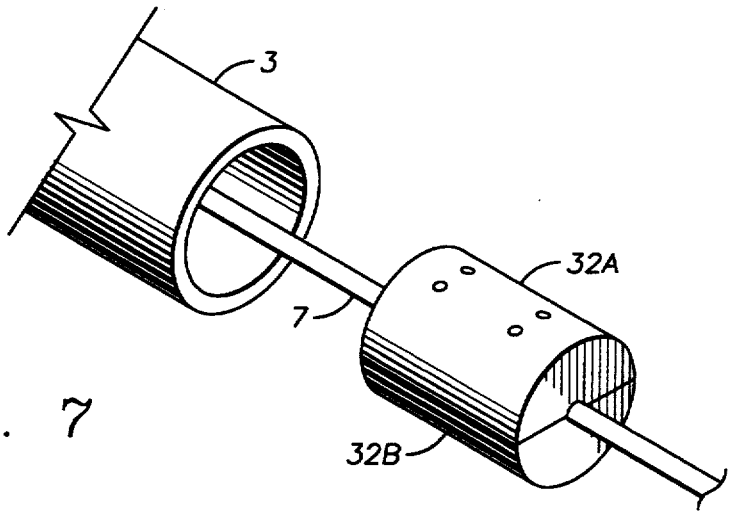
FIG. 7 shows a second piston molded directly to the cable.

FIG. 7 shows an alternative second piston 40, also formed from material soluble in a selected fluid. The body 41 of the piston is molded directly to the cable 7. The second piston is formed by applying a mold form 42 as shown in FIG. 8 to the cable 7 at the point on the cable 7 where a second piston 40 is to be installed, injecting the piston 40 material, which can be a low melting point metal alloy such as Wood's Metal, and cooling the mold form 42 by injecting water into a cooling jacket 42A within the mold form 42. The piston 40 of the present embodiment functions in a similar manner to the second piston of the third embodiment. When insertion of the cable 7 is completed, the second pistons 40 formed from Wood's Metal are dissolved by pumping water heated to at least 75 degrees Celsius in to the tubing, thereby melting the second pistons. Fluid flow through the coiled tubing 3 is then enabled.

I claim:

1. A method for installing a wireline inside a coiled tubing comprising the steps of:

a) attaching a first piston to a first end of said wireline;

b) inserting said first end of said wireline and said attached first piston into said coiled tubing;

c) applying fluid pressure against said first piston to move said first piston and said attached wireline through said coiled tubing while said coiled tubing is coiled on a transport reel; and d) attaching to said wireline, at spaced apart intervals along said wireline, second pistons for suspending said wireline within said coiled tubing, thereby transporting said wireline through said coiled tubing by said fluid pressure.

2. The method as defined in claim 1 wherein said second pistons comprises:

means for enabling fluid flow through said second pistons upon application of a selected differential pressure across said second pistons.

3. The method as defined in claim 2 wherein said means for enabling fluid flow through said second pistons comprises at least one pressure rupture disk on each of said second pistons.

4. A method for installing a wireline inside a coiled tubing comprising the steps of:

a) attaching a pump-through head to one end of said coiled tubing, said pump-through head adapted to enable passage of said wireline through said pump-through head, and comprising a fluid inlet and a removable packing;

b) removing said removable packing from said pump-through head;

c) connecting a fluid pump dischargingly to said fluid inlet of said pump-through head;

d) attaching a first piston to one end of said wireline;

e) inserting said first piston and a portion of said wireline through said pump-through head, and reattaching said removable packing;

f) operating said fluid pump so as to move said first piston further into said coiled tubing while said tubing is coiled on a transport reel;

g) stopping said fluid pump and attaching a second piston for suspending said wireline within said coiled tubing onto said wireline;

h) removing said removable packing and inserting said second piston through said pump-through head;

i) reattaching said removable packing and restarting said fluid pump; and j) repeating all of steps f through i above at spaced apart locations along said wireline until said wireline is inserted through said coiled tubing.

5. The method as defined in claim 4 further comprising the step of restraining said wireline from further entering said coiled tubing and operating said fluid pump until hydraulic communication is enabled through said second pistons.

6. A method for installing a wireline inside a coiled tubing comprising the steps of:

a) attaching a first piston to a first end of said wireline;

b) inserting said first end of said wireline and said attached first piston into said coiled tubing;

c) applying fluid pressure against said first piston to move said first piston and said attached wireline through said coiled tubing while said coiled tubing is coiled on said transport reel; and d) attaching to said wireline, at spaced apart intervals along said wireline, second pistons for suspending said wireline within said coiled tubing, thereby transporting said wireline through said coiled tubing by said fluid pressure, each of said second pistons comprising a material soluble in a solvent to enable fluid flow through said second pistons upon pumping of said solvent into said coiled tubing.

7. A method for installing a wireline inside a coiled tubing comprising the steps of:

attaching a first piston to a first end of said wireline;

inserting said first end of said wireline and said attached first piston into said coiled tubing;

applying fluid pressure against said first piston to move said first piston and said attached wireline through said coiled tubing; and attaching second pistons to said wireline at spaced apart locations along said wireline, said second pistons substantially sealing an annular space between said coiled tubing and said wireline, each of said second pistons also having at least one pressure rupture disk.

8. The method as defined in claim 7 further comprising the step of restraining said wireline from further entering said coiled tubing, and operating said fluid pump until hydraulic communication is enabled through said second pistons.

9. A method for installing a wireline inside a coiled tubing comprising the steps of:

attaching a first piston to a first end of said wireline;

inserting said first end of said wireline and said attached first piston into said coiled tubing;

applying fluid pressure against said first piston to move said first piston and said attached wireline through said coiled tubing;

attaching second pistons to said wireline at spaced apart locations along said wireline, said second pistons substantially sealing an annular space between said coiled tubing and said wireline, said second pistons constructed of material soluble in a solvent; and pumping said solvent into said coiled tubing to enable fluid flow through said second pistons.

10. The method as defined in claim 9 further comprising the step of restraining said wireline from further entering said coiled tubing and pumping said solvent until said solvent has dissolved said second pistons and hydraulic communication is enabled through said second pistons.

* * * * *